US008144061B2

(12) United States Patent
Sakuma

(10) Patent No.: US 8,144,061 B2
(45) Date of Patent: Mar. 27, 2012

(54) ANTENNA AND COMMUNICATION DEVICE HAVING SAME

(75) Inventor: Masao Sakuma, Shinjuku (JP)

(73) Assignee: Fujitsu Semiconductor Limited, Yokohama (JP)

( * ) Notice: Subject to any disclaimer, the term of this patent is extended or adjusted under 35 U.S.C. 154(b) by 389 days.

(21) Appl. No.: 12/423,557

(22) Filed: Apr. 14, 2009

(65) Prior Publication Data

US 2009/0273523 A1 Nov. 5, 2009

(30) Foreign Application Priority Data

Apr. 30, 2008 (JP) ..... 2008-118893

(51) Int. Cl.
*H01Q 1/38* (2006.01)
*H01Q 1/48* (2006.01)

(52) U.S. Cl. ..... 343/700 MS; 343/702; 343/846

(58) Field of Classification Search ..... 343/700 MS, 343/702, 846
See application file for complete search history.

(56) References Cited

U.S. PATENT DOCUMENTS 4,051,477 A * 9/1977 Murphy et al. ..... 343/700 MS
4,401,988 A * 8/1983 Kaloi ..... 343/700 MS
6,392,601 B1 * 5/2002 Ku et al. ..... 343/700 MS
6,914,570 B2 * 7/2005 Asrani et al. ..... 343/702
7,202,818 B2 * 4/2007 Anguera Pros et al. ..... 343/700 MS
7,233,291 B2 * 6/2007 Elkobi et al. ..... 343/702
7,446,712 B2 * 11/2008 Itoh et al. ..... 343/700 MS
7,821,460 B2 * 10/2010 Schillmeier et al. ... 343/700 MS
2009/0058731 A1 * 3/2009 Geary et al. ..... 343/700 MS

FOREIGN PATENT DOCUMENTS

JP 2007-13643 A 1/2007
JP 2007-142878 A 6/2007

OTHER PUBLICATIONS

Kim, Yongho et al.; "Study and Reduction of the Manual Coupling between Two L-shaped Folded Monopole Antennas for Handset"; Technical Report of IEICE; Mar. 27, 2007.
Korean Office Action dated Aug. 23, 2011 with English Translation.

* cited by examiner

*Primary Examiner* — Hoang V Nguyen
(74) *Attorney, Agent, or Firm* — Arent Fox LLP

(57) ABSTRACT

An antenna device, including a radiating element having a feed portion and a floating conduction member, which is provided between the radiating element and a conduction board having a high-frequency signal source which generates high-frequency signals for supplying to the feed portion, and which is electrically floated.

17 Claims, 11 Drawing Sheets

ANTENNA AND COMMUNICATION DEVICE HAVING SAME

CROSS-REFERENCE TO RELATED APPLICATIONS

This application is based upon and claims the benefit of priority from the prior Japanese Patent Application No. 2008-118893, filed on Apr. 30, 2008, the entire contents of which are incorporated herein by reference.

FIELD

The present invention relates to an antenna and to a communication device having such an antenna.

BACKGROUND

MIMO (Multiple Input, Multiple Output) communication method has been proposed as transmission technology to increase the wireless communication speed on wireless LANs. In MIMO, a plurality of antennas is provided, and different transmission signal are transmitted simultaneously from a plurality of transmission antennas in the same channel by choosing channel or frequency. By this transmission, the overall transmission quantity can be increased without expanding the frequency bandwidth. That is, the transmission signal series can be increased without expanding the frequency band, so that the efficiency of frequency utilization and the wireless transmission speed may be increased.

Further, when performing diversity transmission, a plurality of antennas are provided, an antenna with high receiver gain would have high sensitivity. It also receive higher power via different transmission paths.

Antennas used in MIMO communication methods and diversity transmission methods are described in Japanese Patent Laid-open No. 2007-142878, Japanese Patent Laid-open No. 2007-13643, and in "Study Relating to Reduced Mutual Coupling Between L-shape Loopback Monopole Antenna Elements for Portable Terminals" (Keitai Tanmatsu yo L-ji gata Orikaeshi Monopo-ru Antena no Soshi kan Sougo Ketsugou Teigen ni Kansuru Ichi Kentou), Yongho Kim, Jun Itoh, and Hisashi Morishita, Department of Electrical and Electronic Engineering, National Defense Academy of Japan, IEICE Tech. Rep., announced at Okinawa Univ., Mar. 27, 2008. In Japanese Patent Laid-open No. 2007-142878, a multi-antenna for terminals is described that when a plurality of antenna elements are used in wireless terminal device, the first antenna group is set in a first place, and a second antenna group in a second place perpendicular to the first one, and it proved the influence of mutual coupling of the first and second antennas is reduced.

Further, in Japanese Patent Laid-open No. 2007-13643, an integral-type plate multi-element antenna is described, First and second radiating elements are provided, having feed portions on both sides of the cutout portion of a ground pattern having a cutout portion, so that the electromagnetic interaction between radiating elements is reduced, the degree of coupling between radiating elements is reduced, and the characteristics of a plurality of radiating elements are isolated.

IN "Study Relating to Reduced Mutual Coupling Between L-shape Loopback Monopole Antenna Elements for Portable Terminals" (Keitai Tanmatsu yo L-ji gata Orikaeshi Monopo-ru Antena no Soshi kan Sougo Ketsugou Teigen ni Kansuru Ichi Kentou), Yongho Kim, Jun Itoh, and Hisashi Morishita, Department of Electrical and Electronic Engineering, National Defense Academy of Japan, IEICE Tech. Rep., announced at Okinawa Univ., Mar. 27, 2008, a MIMO communication method antenna is described, a conductive bridge is provided which couples the ground terminal portions of a pair of radiating elements, and reduces the mutual coupling between the radiating elements.

In the case of a terminal antenna of the prior art, when a radiating element of the antenna is brought into proximity with the conducting board (circuit board) on which the radiating element is installed, the radiating element and the conducting board undergo electromagnetic interaction, so that the resonance frequency of the antenna is shifted from the desired frequency, and in addition the reflection coefficient (VSWR, voltage Standing Wave Ratio) rises and the antenna gain falls. For example, in the case of the 2.4 GHz band, the element cannot be brought to within $\lambda/16(\approx 0.125/16 \approx 7.8125$ mm) due to the above problem. In particular, an inverted F-type antenna and L-shape antenna used in portable terminals have a low fractional bandwidth (bandwidth relative to the center frequency) of approximately 6%, so that movement of the resonance frequency should be avoided.

On the other hand, in the case of a wireless LAN card inserted into a laptop computer, it is desirable that the antenna is within the card housing. Similar in portable telephones and other portable data terminals, it is desirable that the antenna and the conduction board (circuit board) on which the antenna is mounted be configured compactly. However, as explained above, a radiating element cannot be brought closer than approximately $\lambda/16$ to the conduction board, or impeding a compact design.

SUMMARY

According to an aspect of the invention, an antenna device, includes a radiating element having a feed portion and a floating conduction member, which is provided between the radiating element and a conduction board having a high-frequency signal source which generates high-frequency signals for supplying to the feed portion, and which is electrically floated.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

Figure 1:
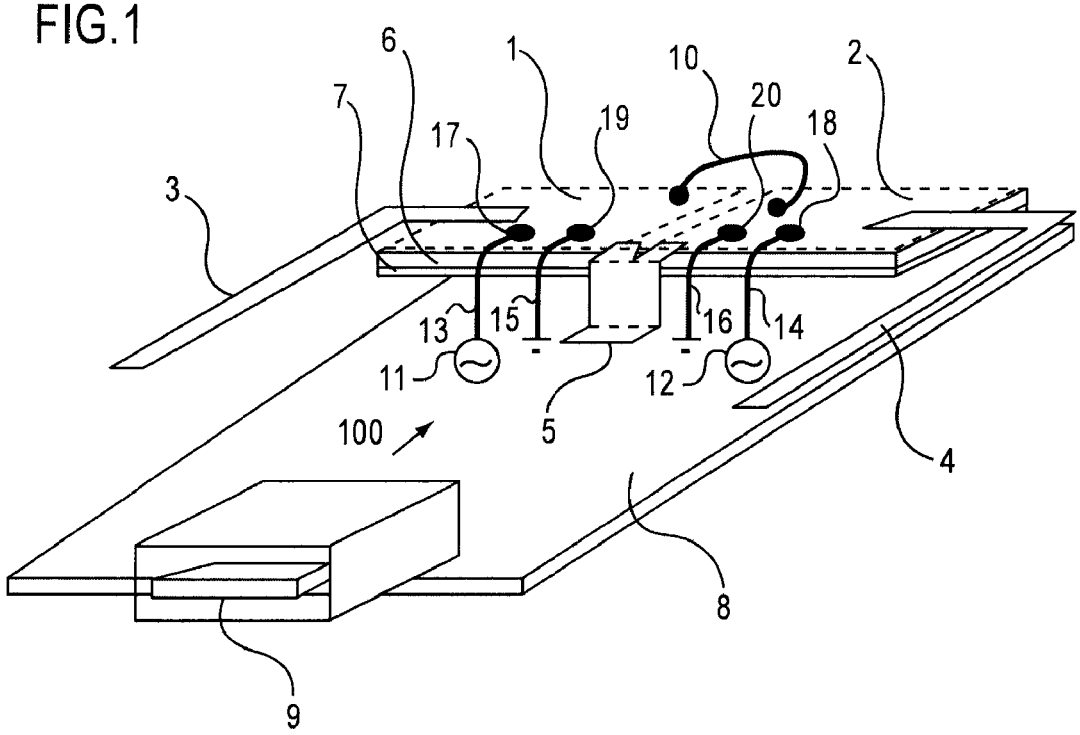
FIG. 1 is a perspective view of a transmission device having the antenna of a first embodiment.

Below, embodiments of the invention are explained referring to the drawings. However, the technical scope of the invention is not limited to these embodiments, but extends to the inventions described in the Scope of Claims, and to inventions equivalent thereto.

Figure 2:
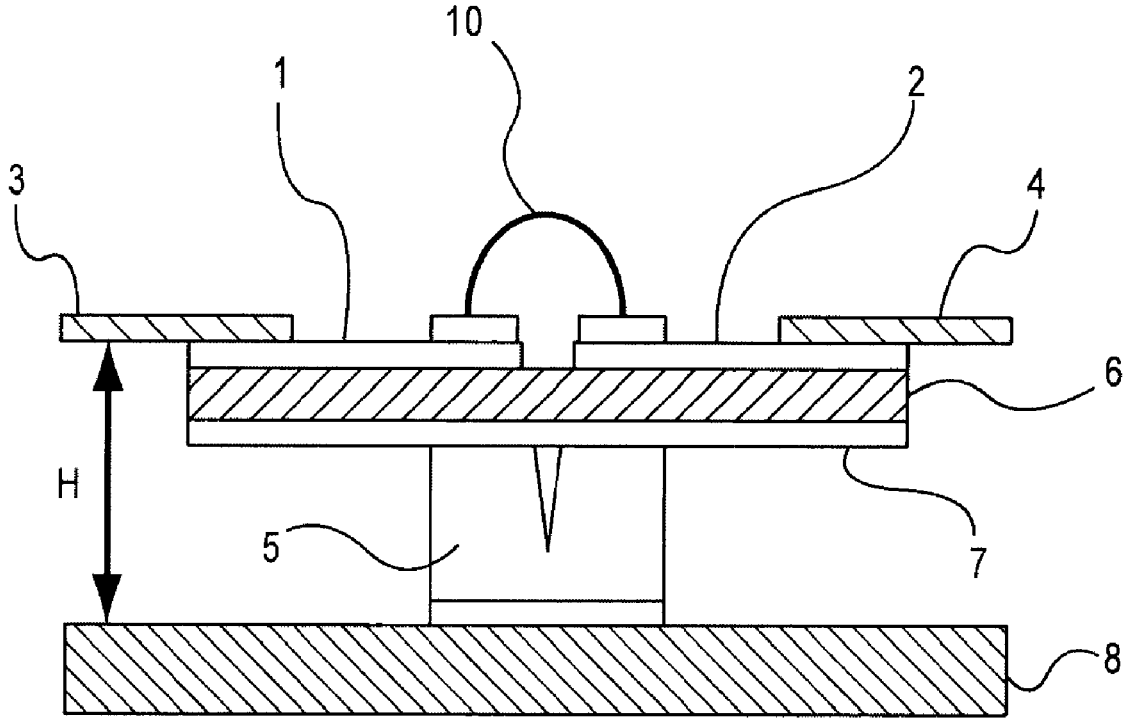
FIG. 2 is a side view, seen from the opposite direction of the arrow 100 in FIG. 1.
Figure 3:
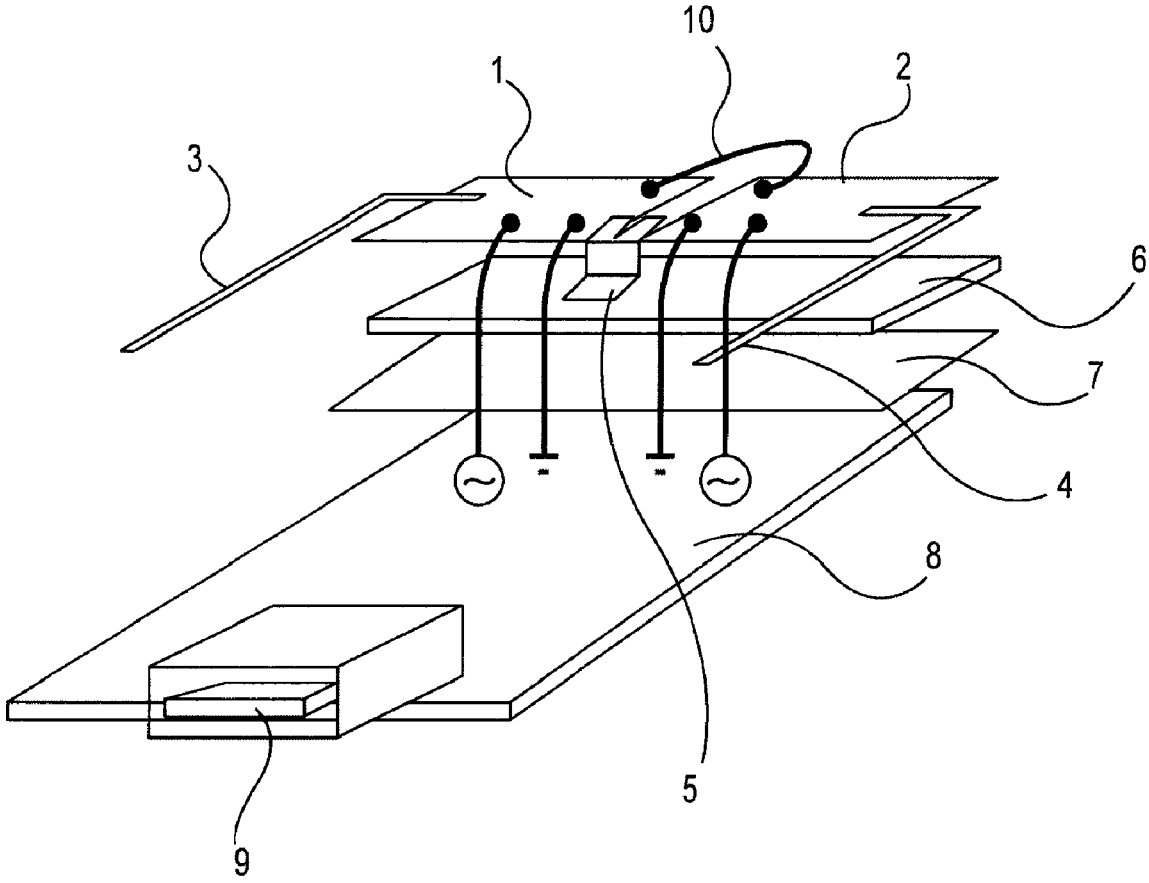
FIG. 3 is an exploded perspective view which shows in separation the portions of the radiating elements 1, 2 of the antenna of FIG. 1.

FIG. 1 is a perspective view of a transmission device having the antenna of a first embodiment. FIG. 2 is a side view, seen from the opposite direction of the arrow 100 in FIG. 1. And, FIG. 3 is an exploded perspective view which shows in separation the portions of the radiating elements 1, 2 of the antenna of FIG. 1. The configuration of the antenna of this embodiment, and of a transmission device having this antenna, are explained referring to these drawings.

This antenna is configured as a pair of inverted F-type antennas, and has a first antenna, comprising a radiating element 1 formed from copper foil and a narrow width radiating element 3 connected thereto. Second antenna comprises a radiating element 2 formed from copper foil and a narrow width radiating element 4 connected thereto. The pair of radiating elements 1 and 2 is arranged in proximity, and is mounted on the conduction board 8 forming a circuit board by means of a support member 5 comprising an insulating material. That is, the radiating elements 1, 2, 3, 4 are arranged at position of a prescribed height H from the conduction board 8. The narrow width radiating elements 3 and 4 are both formed from copper plate or another conducting material, and are connected to the radiating elements 1 and 2 respectively. And, the narrow width radiating elements 3 and 4 are bent into L shapes, and the tip ends are extended along both edges of the conduction board 8; the tips are left open. The total length of the radiating elements 1 and 3 and the total length of the radiating elements 2 and 4 both have an electrical length of approximately ¼ of the wavelength of the transmission and receiver frequency band.

The conduction board 8 forms a circuit board, and comprises high-frequency signal sources 11, 12 which generate high-frequency signals for transmission from the antenna. The high-frequency signal sources 11, 12 and feed points 17, 18, positioned in the center of the radiating elements 1, 2 are connected via feed lines 13, 14. Although not shown in FIG. 1 to FIG. 3, as explained below using FIG. 11, it is more accurate to say that the feed lines 13, 14 are formed by the inner conductors of coaxial cables. In addition, ground in the circuit board 8 and the right-end non-feed point 19 of the radiating element 1 and left-end non-feed point 20 of the radiating element 2 are connected via the ground lines (non-feed lines) 15, 16. The outer conductors (not shown) of the coaxial cables are also grounded. In FIG. 2, the feed lines 13, 14 and ground lines (non-feed lines) 15, 16 are omitted. At the end portion on the side opposite the antenna placement position on the conduction board 8 which is the circuit board, a connector 9 for connection to a laptop computer is provided. The connector 9 is for example a USB connector.

As is clear from the side view of FIG. 2 and the exploded perspective view of FIG. 3, the floating conduction member 7, made to be electrically floating, is provided between the radiating elements 1, 2 and the conduction board 8. The floating conduction member 7 is formed from, for example, copper sheet. The floating conduction member 7 is affixed to the radiating elements 1, 2 with a dielectric layer 6 intervening. The dielectric layer 6 is for example formed from an epoxy board, and has a dielectric constant $\in$ greater than the dielectric constant of air, $\in=1$; for example, $\in=4.8$.

By placing the floating conduction member 7 between the radiating elements 1, 2 and the conduction board 8, electromagnetic fields between the radiating elements 1, 2 and the conduction board 8 are blocked, and the effect of the radiating elements 1, 2 on the conduction board 8 can be suppressed. As a result, the radiating elements 1, 2 can be provided in proximity to the conduction board 8, and a low-profile antenna can be realized.

If the radiating elements 1, 2 are brought into proximity with the conduction board 8 without a floating conduction member 7 intervening for example the wavelength of transmission/receiver signals is $\lambda$, then when the distance becomes less than $\lambda/16$ (in the 2.4 GHz band, $\lambda/16\approx7.8125$ mm), the radiating elements 1, 2 and the conduction board 8 are electromagnetically coupled, and a shift in the resonance frequency is confirmed. Further, according to experiments by the inventor, when the distance is reduced to less than $\lambda/16$, in addition to a shift of the resonance frequency from the carrier frequency, the reflection coefficient VSWR rises, and that the antenna gain reduce.

On the other hand, by providing a floating conduction member 7, even when the radiating elements 1, 2 are brought into proximity with the conduction board 8 to within approximately $\lambda/16$ to $\lambda/64$, and more preferably $\lambda/32$ to $\lambda/64$, there is no shift in the resonance frequency, and the reflection coefficient VSWR does not rise. Rather, by providing the floating conduction member 8, the reflection coefficient VSWR could be lowered. However, the inventor confirmed that if the distance between the radiating elements 1, 2 and the conduction board 8 is made less than $\lambda/64$, there is again a rise in the reflection coefficient VSWR.

Figure 4:
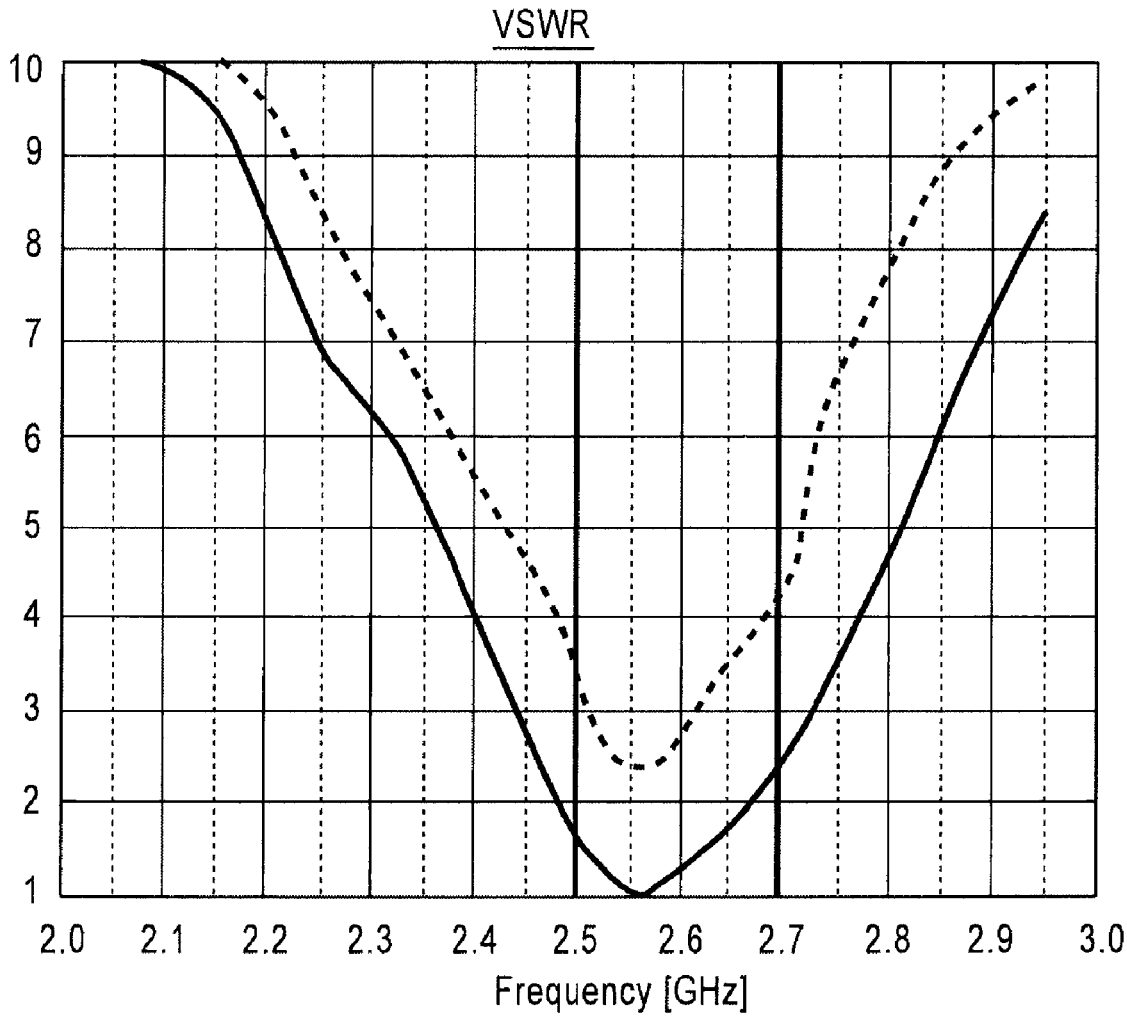
FIG. 4 is reflection coefficient data versus frequency based on the results of experiments conducted by the inventor.

FIG. 4 shows reflection coefficient data versus frequency based on the results of experiments conducted by the inventor. The dashed line is data for a model of the prior part, and the solid line is data for an example model of this embodiment. In the example model, a radiating element 1 employing copper foil of thickness 18 μm is mounted on a conduction board 8 by means of a support member 5 formed from insulating material, and a floating conduction member 7 employing copper foil of thickness 18 μm is provided, via a dielectric layer 6 comprising epoxy material of thickness approximately 150 μm, on the radiating element 1. The experimental model has only one antenna. The distance H between the radiating element 1 and the conduction board 8 is approximately 3 mm. Here, for the case of the 2.4 GHz band, 3 mm is such that $\lambda/32(\approx3.91\text{ mm})>3\text{ mm}>\lambda/62(\approx1.95\text{ mm})$.

On the other hand, in the model of the prior part, the floating conduction member 7 and dielectric layer 6 of the above example model are not provided. And, the distance H between the radiating element 1 and conduction board 8 is approximately $\lambda/16(\approx7.82\text{ mm})$.

As shown in FIG. 4, in the model of the prior part, by maintaining the distance between the radiating element 1 and the conduction board 8 at approximately $\lambda/16$, the reflection coefficient VSWR near the desired frequency of 2.4 GHz takes on a minimum value, and the antenna gain can be made high in this frequency band. However, experiments by the inventor have confirmed that if the distance H is made smaller than $\lambda/16$, the reflection coefficient VSWR rises, and moreover the frequency at which the reflection coefficient is minimum deviates greatly from 2.4 GHz.

On the other hand, in the example model a floating conduction member 7 is provided between the radiating element 1 and the conduction board 8, so that even when the distance H between the radiating element 1 and the conduction board 8 is reduced to approximately 3 mm, the reflection coefficient VSWR assumes the minimum value near the desired frequency of 2.4 GHz, as indicated by the solid line, and a high antenna gain can be maintained at that frequency. That is, even when the radiating element 1 is brought into proximity with the conduction board 8, a shift in resonance frequency does not occur. Further, the reflection coefficient indicated by the solid line is observed to be lower than that of the model of the prior art, indicated by the dashed line. That is, the gain of the antenna in the example model is higher than for the model of the prior art.

By providing the dielectric member 6 between the radiating element 1 and the floating conduction member 7, the capacitance value formed by the radiating element 1 can be made higher. And, by providing a dielectric member 6 with a dielectric constant $\in>1$, the area of the radiating element 1 can be made small. Further, by providing the dielectric member 6, the bandwidth can be further broadened. The wavelength can be shortened by adding a capacitance to the antenna element itself, so that the antenna length can be shortened. And, it is well known by practitioners of the art that, by capacitive coupling without changing the antenna length, the bandwidth can be expanded.

In the antenna of this embodiment appearing in FIG. 1 to FIG. 3, the distance between the pair of radiating elements 1, 2 is for example 1 to 2 mm. And, the non-feed points 19, 20 of the pair of radiating elements 1, 2 (or points in proximity to these points) are coupled by the conductive coupling member 10. Through coupling of the non-feed points 19, 20 by the conductive coupling member 10, the coupling between the pair of antenna radiating elements can be reduced. The conductive coupling member 10 need only be of conductive material, and may for example be copper wire. With respect to reduction of the coupling between elements by this conductive coupling member 10, a similar bridge is described in "Study Relating to Reduced Mutual Coupling Between L-shape Loopback Monopole Antenna Elements for Portable Terminals" (Keitai Tanmatsu yo L-ji gata Orikaeshi Monoporu Antena no Soshi kan Sougo Ketsugou Teigen ni Kansuru Ichi Kentou), Yongho Kim, Jun Itoh, and Hisashi Morishita, Department of Electrical and Electronic Engineering, National Defense Academy of Japan, IEICE Tech. Rep., announced at Okinawa Univ., Mar. 27, 2008.

Figure 5:
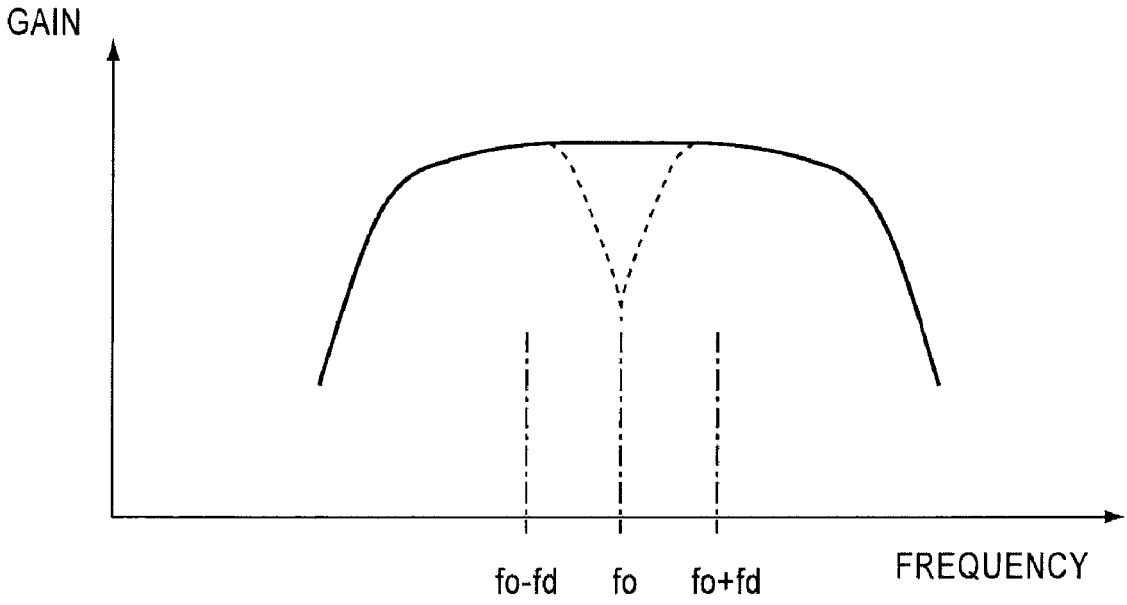
FIG. 5 is a S21 gain characteristic from antenna to antenna gain characteristic versus frequency for the antenna of this embodiment.

FIG. 5 shows the gain characteristic versus frequency for the antenna of this embodiment. By providing the pairs of radiating elements 1 and 3, and 2 and 4 in proximity, a prescribed gain can be obtained in a frequency band with center frequency at the resonance frequency f0, as indicated by the solid line. The gain of the pair of antennas in proximity is higher, when the pair of antennas is electromagnetically coupled, than the gain of a single antenna.

In the antenna of this embodiment shown in FIG. 1 to FIG. 3, the ground supply points (non-feed points) 19, 20 of the pair of radiating elements 1, 2 are coupled by the conductive coupling member 10. The inventor discovered that by using the conductive coupling member 10 to couple the radiating elements 1, 2 in this way, the gain near the resonance frequency f0 declines, as indicated by the dashed line in FIG. 5. Due to the decline in gain indicated by this dashed line, the characteristic of the pair of antennas is such that higher-gain characteristics can be obtained in the frequency bands with frequencies f0−fd and f0+fd. This gain-frequency characteristic means that the pair of antennas is equivalent to having two resonance frequencies and frequency bands, and is effective as a MIMO transmission-type antenna. That is, coupling between the pair of antenna radiating elements is reduced.

In a MIMO transmission method, different data is transmitted from a pair of antennas on the transmission side at the same carrier frequency f0. The transmission signals transmitted from the antennas are received by a pair of antennas on the receiving side with slightly different phases. The two received signals have close frequency, and so the frequency bands of the two received signals overlap in FIG. 5. Hence the pair of receiving antennas can receive two signals in frequency bands at each of the frequencies f0−fd and f0+fd. In the receiver circuit, the phase difference is detected and the two received signals are separated. If the transmission signals are subjected to code spreading, separation can be performed by code despreading.

It was confirmed by this inventor that by adjusting the length of the conductive coupling member 10, the frequency at which the gain falls as indicated by the dashed line in FIG. 5 can be adjusted. Qualitatively, when the length of the conductive coupling member 10 is increased, the gain-drop frequency falls, and when the length of the conductive coupling member 10 is decreased, the gain-drop frequency rises. Hence it is desirable that the length of the conductive coupling member 10 be adjusted such that the gain-drop frequency and the carrier frequency f0 coincide. The specific length of the conductive coupling member 10 is adjusted in accordance with the impedance and capacitance of the radiating elements. Adjustment of the length of the conductive coupling member 10 is equivalent to adjustment of the electrical length of the radiating elements. This adjustment can also be performed by means of lumped constants.

Figure 6:
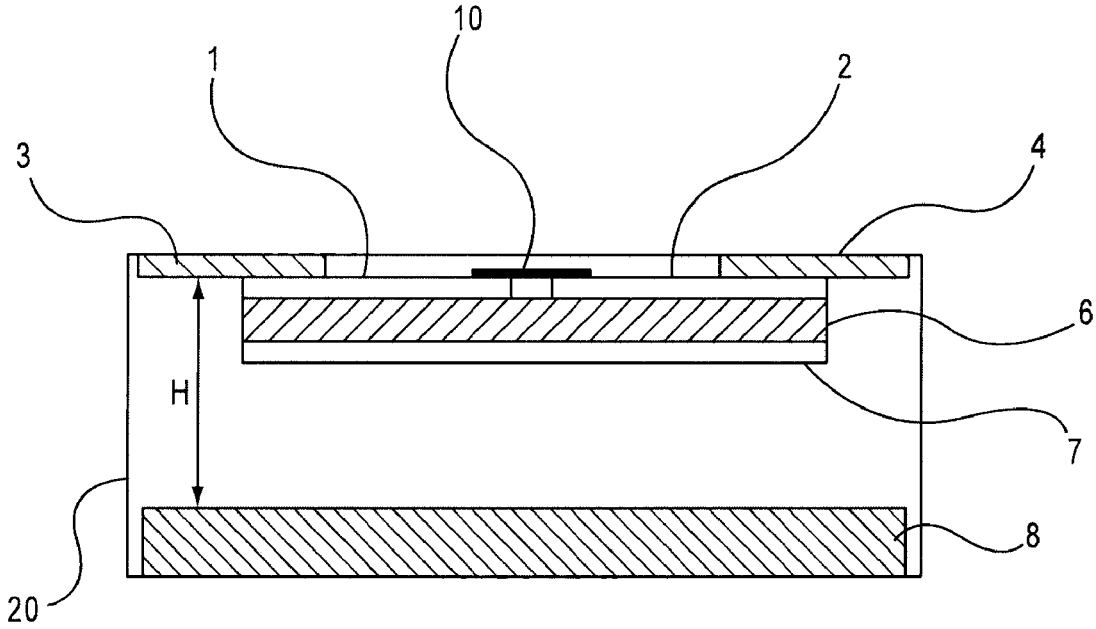
FIG. 6 is a cross-sectional view of a transmission device having the antenna of this embodiment, and corresponds to the side view of FIG. 2.

FIG. 6 is a cross-sectional view of a transmission device having the antenna of this embodiment, and corresponds to the side view of FIG. 2. In FIG. 1 to FIG. 3, the radiating elements 1, 2 are mounted on the conduction board (circuit board) 8 by the support member 5, formed from an insulating material. On the other hand, in the example of FIG. 6, a circuit board 8, a pair of radiating elements 1 and 2, L-shape radiating elements 3 and 4, a dielectric film 6, a floating conduction member 7, and a conductive coupling member 10 are housed within a hexahedral housing 21, with the external appearance of a card having a prescribed thickness. Hence the housing 21, formed from an insulating material, supports radiating elements 1, 2 at a position a desired height H from the circuit board 8. By mounting radiating elements 1 to 4 on the upper and inner face of the housing 21, the interval between the radiating elements 1, 2 and the circuit board 8 can be made the distance H. As explained above, this height H is from $\lambda/16$ to $\lambda/64$, or from $\lambda/32$ to $\lambda/64$.

Figure 7:
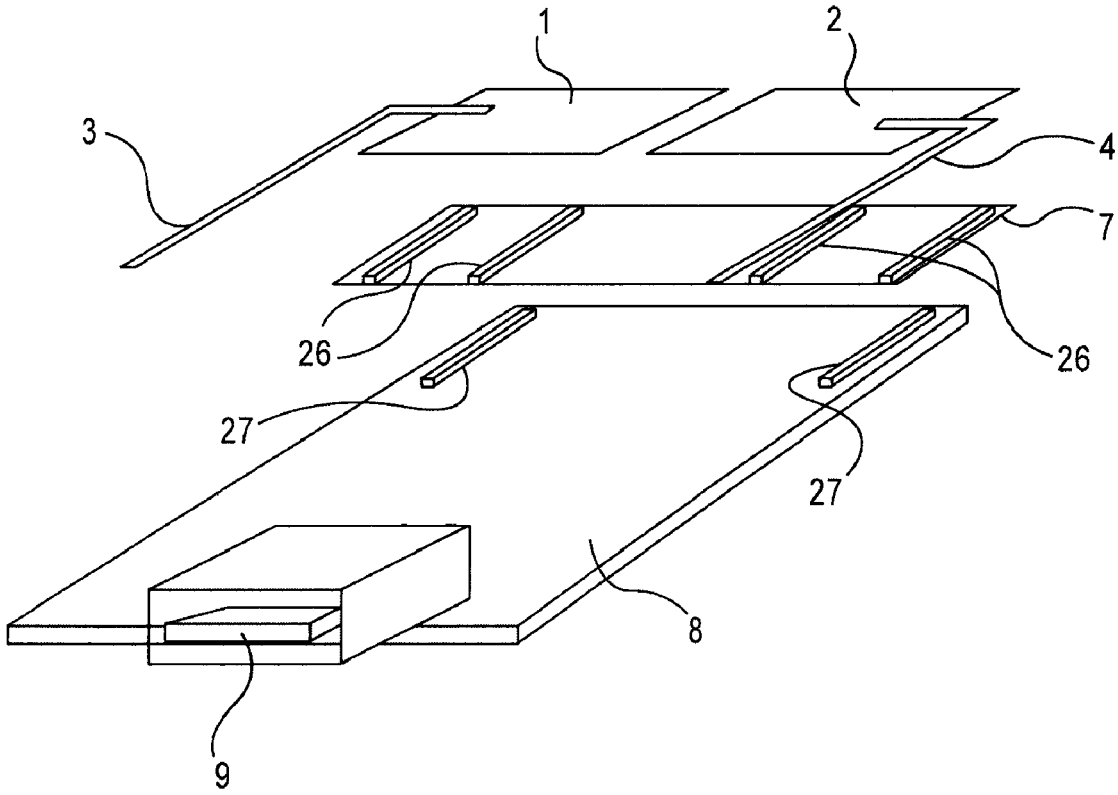
FIG. 7 is an exploded perspective view and a cross-sectional view of a transmission device having the antenna of a second embodiment.
Figure 8:
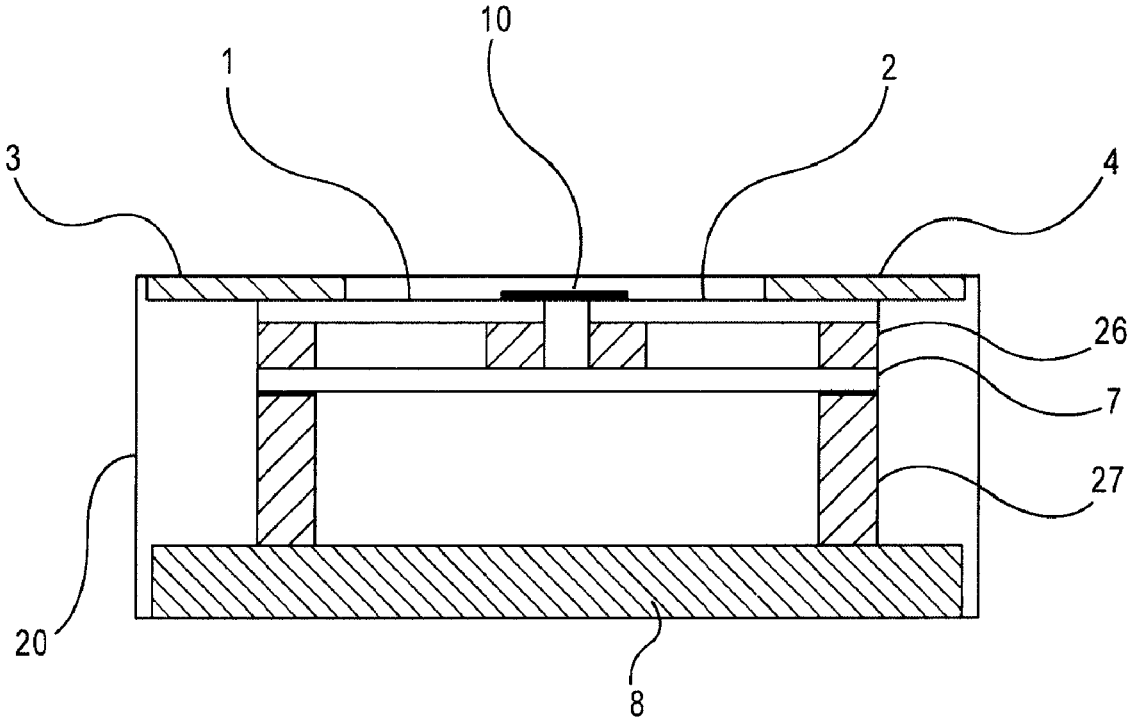
FIG. 8 is an exploded perspective view and a cross-sectional view of a transmission device having the antenna of a second embodiment.

FIG. 7 and FIG. 8 are an exploded perspective view and a cross-sectional view of a transmission device having the antenna of a second embodiment. In this embodiment, the floating conduction member 7 is mounted on the radiating elements 1, 2, with four dielectric material members 26 intervening. The dielectric material members 26 comprise, for example, styrofoam, and contain large amounts of air in the interior thereof, so that the dielectric constant $\in$ is close to 1. However, the area of the dielectric material members 26 is far smaller than the area of the radiating elements 1, 2, or than the area of the floating conduction member 7. Hence the radiating elements 1, 2 and the floating conduction member 7 are effectively separated by layers of air.

Further, the floating conduction member 7 is mounted on the circuit board 8 with similar dielectric material members 27 intervening. That is, the floating conduction member 7 is mounted on the circuit board 8 by means of a pair of dielectric material members 27 at both ends. Hence the sum of the thickness of the dielectric material members 26, 27 and the thickness of the floating conduction member 7 is the distance between the radiating elements 1, 2 and the circuit board 8. As explained above, this distance is from λ/16 to λ/64, or from λ/32 to λ/64.

As described above, even when a dielectric layer is not formed between the radiating elements 1, 2 and the floating conduction member 7, the height of the radiating elements 1, 2 can be reduced, similarly to the first embodiment.

In FIG. 7, a conductive coupling member 10 to perform coupling of the pair of radiating elements 1, 2 is omitted; but as shown in FIG. 8, it is desirable that the non-feed points 19, 20 of the radiating elements 1, 2 be coupled by a conductive coupling member 10, similarly to the embodiment of FIG. 1 to FIG. 3. As a result, the antenna device has a pair of frequency bands, as shown in FIG. 5.

Figure 9:
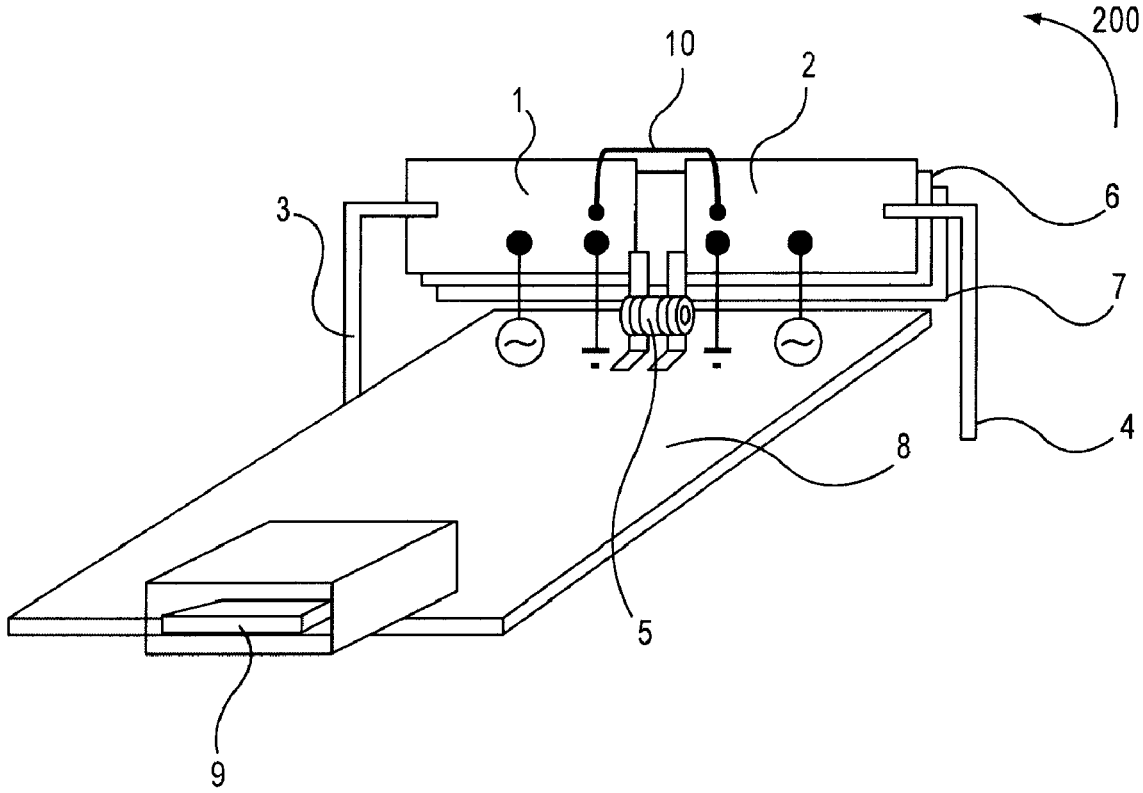
FIG. 9 is a perspective view of a transmission device having the antenna of a third embodiment.

FIG. 9 is a perspective view of a transmission device having the antenna of a third embodiment. In the antenna in this embodiment, the support member 5 in the embodiment of FIG. 1 to FIG. 3 has a hinge structure. By means of the hinge structure of this support member 5, the radiating elements 1, 2 can be rotated in the direction of the arrow 200, and the direction of the radiating elements 1, 2 can be changed from the horizontal direction of FIG. 1 to the vertical direction. By this means, when the radiating elements 1, 2 are arranged in the horizontal direction as in FIG. 1, horizontal-polarization receiver signals are mainly received, and when arranged in the vertical direction as in FIG. 9, vertical-polarization receiver signals can be mainly received. When this transmission card is mounted in a laptop computer, switching of receiver between the horizontal polarization and the vertical polarization can be performed, without changing the position of the laptop computer itself. Other than the above-described hinge structure, the embodiment is the same as the first embodiment.

Figure 10:
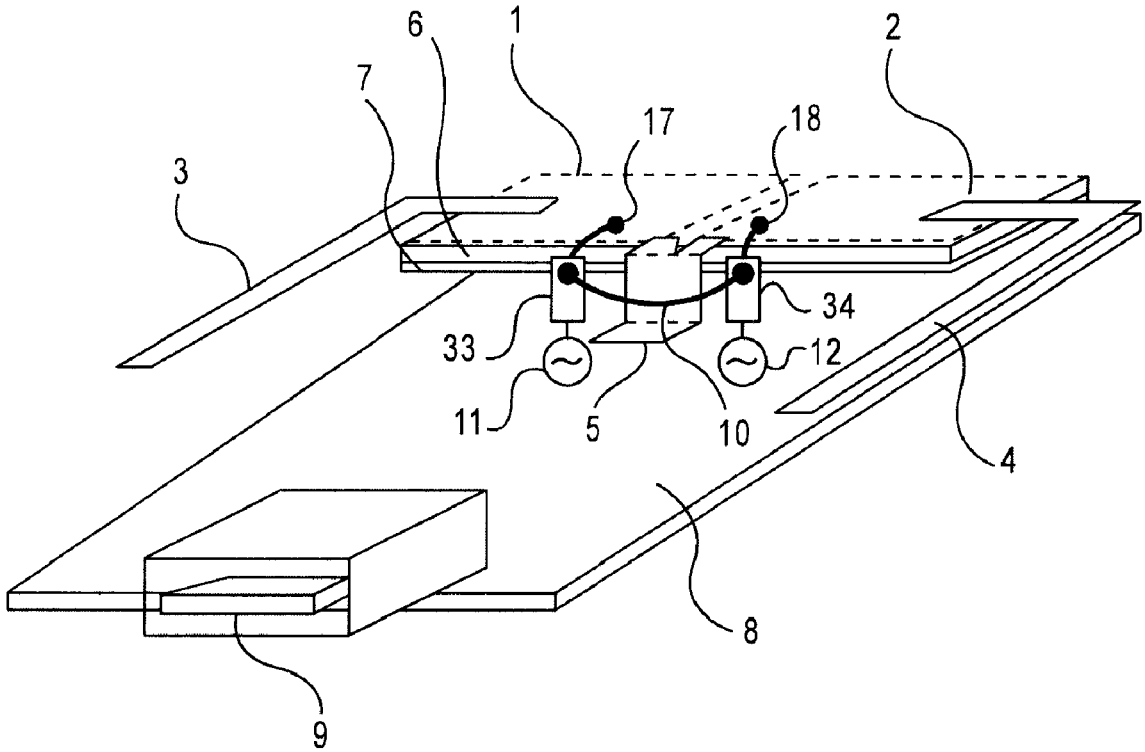
FIG. 10 is a perspective view of a transmission device having the antenna of a fourth embodiment.

FIG. 10 is a perspective view of a transmission device having the antenna of a fourth embodiment. This embodiment is an example of application to an L-type antenna. The first embodiment of FIG. 1 is an example of application to an inverted F-type antenna. On the other hand, in the case of the L-type antenna of FIG. 10, the inner conductors (feed lines) of the coaxial cables 33, 34 connected to the high-frequency signal sources 11, 12 on the circuit board 8 are connected to the feed points 17, 18 of the radiating elements 1, 2. And, the outer conductors (non-feed lines) of the coaxial cables 33, 34 are directly connected by the conductive coupling member 10. And, the outer conductors of the coaxial cables 33, 34 are also connected to ground (not shown) on the circuit board 8. Otherwise, the configuration is the same as in the first embodiment of FIG. 1.

The L-type antenna and the inverted F-type antenna are both widely used as antennas in the 2.4 GHz and other high-frequency bands. And, whatever the type of antenna to which this invention is applied, the distance between the radiating elements 1, 2 and the conduction board 8, which is a circuit board, can be reduced. Moreover, by means of a conductive coupling member 10 the coupling between radiating elements of the antenna can be reduced, and the elements can be made to have a pair of frequency bands.

FIG. 11 shows the connection states of an inverted F-type antenna and an L-type antenna in this embodiment. In FIG. 11, the relations between the feed points 17, 18, in the radiating elements 1, 2, the non-feed points 19, 20, the connection point of the conductive coupling member 10, and the inner and outer conductors of coaxial cables connected to high-frequency signal sources 11, 12, are shown for each of the antennas.

Figure 11A:
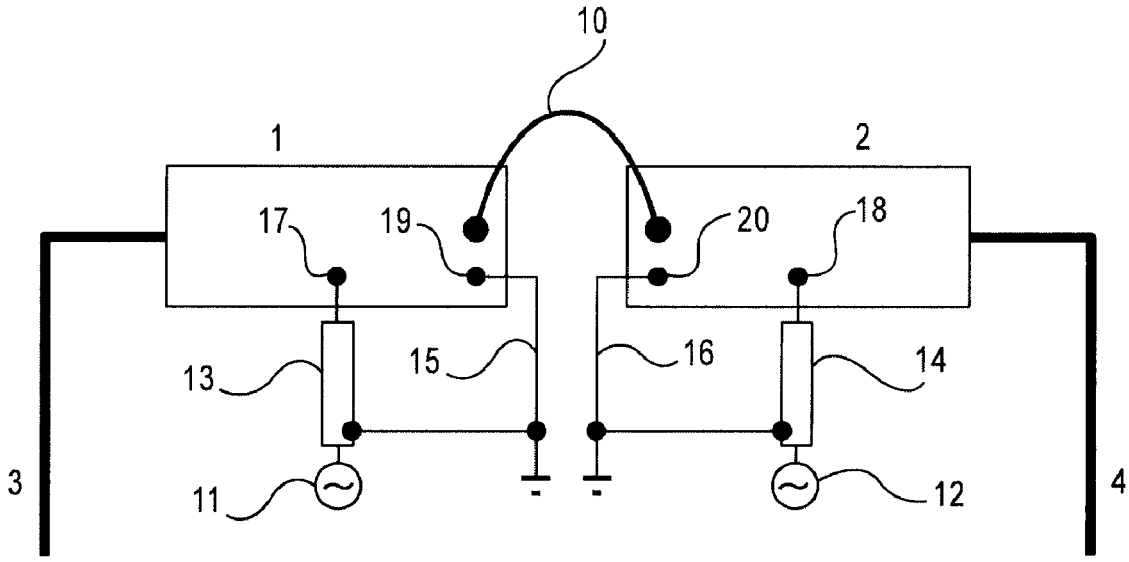
FIGS. 11A and 11B are connection states of an inverted F-type antenna and an L-type antenna in this embodiment.

In the case of the inverted F-type antenna in FIG. 11A, the ends on one end of the inner conductors (feed lines) of the coaxial cables 13, 14 are connected to the feed points 17, 18 in the center portions of the radiating elements 1, 2, and the ends on the other end of the inner conductors are connected to the high-frequency signal sources 11, 12 on the circuit board. The outer conductors of the coaxial cables 13, 14 are connected to ground on the circuit board. And, the non-feed points 19, 20 at the ends of the radiating elements 1, 2 opposite the narrow radiating elements 3, 4 are connected to one end of each of the non-feed lines 15, 16, while the other ends of the non-feed lines 15, 16 are connected to ground on the circuit board. Further, the non-feed points 19, 20 (or the vicinities thereof) are coupled by the conductive coupling member 10.

Figure 11B:
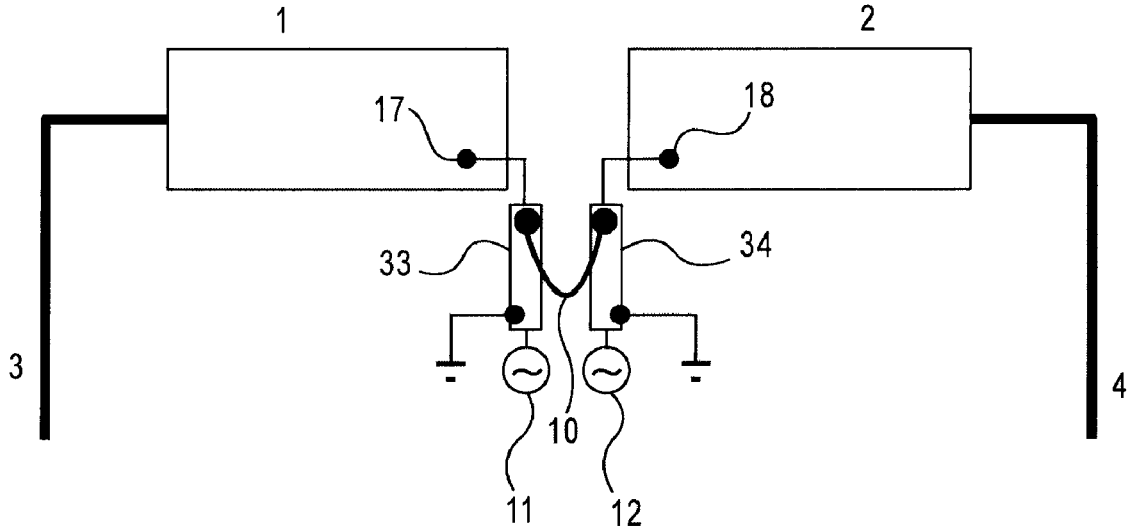

On the other hand, in the case of the L-type antenna in FIG. 11B, the feed points 17, 18 at the ends of the radiating elements 1, 2 opposite the narrow radiating elements 3, 4 are connected to the ends of one end of the inner conductors (feed lines) of the coaxial cables 33, 34, and the other ends of the inner conductors are connected to the high-frequency signal sources 11, 12 on the circuit board. The outer conductors of the coaxial cables 33, 34 are connected to ground on the circuit board. And, the outer conductors of the coaxial cables 33, 34 are coupled by the conductive coupling member 10.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment of the present invention has been described in detail, it should be understood that the various changes, substitutions, and alterations could be made hereto without departing from the spirit and scope of the invention.

The invention claimed is:

1. An antenna device, comprising:

a radiating element having a feed portion; and a floating conduction member being electrically floated, which is provided between the radiating element and a conduction board having a high-frequency signal source which generates high-frequency signals for supplying to the feed portion.

2. The antenna device according to claim 1, wherein a distance between the radiating element and the conduction board is less than 1/16, and equal to or greater than 1/64 wavelength of resonance frequency signals.

3. The antenna device according to claim 2, wherein the distance between the radiating element and the conduction board is between 1/32 and 1/64 wavelength of resonance frequency signals.

4. The antenna device according to claim 2, further comprising a dielectric member, between the radiating element and the floating conduction member, having a dielectric constant higher than a dielectric constant of air.

5. An antenna device, comprising:

first and second radiating elements, each having a feed portion;

a floating conduction member being electrically floated, which is provided between the first and second radiating elements and a conduction board having a high-frequency signal source which generates high-frequency signals for supplying to the feed portions; and a conductive connection member, which couples the first and second radiating elements.

6. The antenna device according to claim 5, wherein a distance between the first and second radiating elements, and the conduction board is less than 1/16, and equal to or greater than 1/64 wavelength of resonance frequency signals.

7. The antenna device according to claim 6, wherein the distance between the first and second radiating elements, and the conduction board is between 1/32 and 1/64 wavelength of resonance frequency signals.

8. The antenna device according to claim 6 or claim 7, further comprising a dielectric member, between the first and second radiating elements and the floating conduction member, having a dielectric constant higher than a dielectric constant of air.

9. A transmission device with an antenna, comprising:

a radiating element having a feed portion;

a conduction board having a high-frequency signal source which generates high-frequency signals for supplying to the feed portion; and a floating conduction member being electrically floated, which is provided between the radiating element and the conduction board.

10. The transmission device according to claim 9, wherein a distance between the radiating element and the conduction board is less than 1/16, and equal to or greater than 1/64 wavelength of resonance frequency signals.

11. The transmission device according to claim 10, wherein the distance between the radiating element and the conduction board is between 1/32 and 1/64 wavelength of resonance frequency signals.

12. The transmission device according to claim 10 or claim 11, further comprising a dielectric member, between the radiating element and the floating conduction member, having a dielectric constant higher than a dielectric constant of air.

13. A transmission device with an antenna, comprising:

first and second radiating elements, each having a feed portion;

a conduction board having first and second high-frequency signal sources which generate high-frequency signals for supplying to the feed portions; and, a floating conduction member being electrically floated, which is provided between the first and second radiating elements, and the conduction board.

14. The transmission device according to claim 13, wherein a distance between the first and second radiating elements, and the conduction board is less than 1/16 wavelength, and equal to or greater than 1/64 wavelength of resonance frequency signals.

15. The transmission device according to claim 13, wherein the distance between the first and second radiating elements, the conduction board is between 1/32 and 1/64 wavelength of resonance frequency signals.

16. The transmission device according to claim 14 or claim 15, further comprising a dielectric member, between the first and second radiating elements and the floating conduction member, having a dielectric constant higher than a dielectric constant of air.

17. The transmission device according to claim 13, further comprising a conductive connection member that couples the first and second radiating elements.

* * * * *